US008545100B2

(12) United States Patent
Urushidani

(10) Patent No.: US 8,545,100 B2
(45) Date of Patent: Oct. 1, 2013

(54) BOTTOM OPENING POUCHES AND CONSUMER PRODUCTS MADE USING SUCH POUCHES

(75) Inventor: Yukihiro Urushidani, Webster Groves, MO (US)

(73) Assignee: Nestec S.A., Vevey (CH)

( * ) Notice: Subject to any disclaimer, the term of this patent is extended or adjusted under 35 U.S.C. 154(b) by 472 days.

(21) Appl. No.: 12/734,387

(22) PCT Filed: Nov. 13, 2008

(86) PCT No.: PCT/US2008/012779

§ 371 (c)(1), (2), (4) Date: Apr. 28, 2010

(87) PCT Pub. No.: WO2009/067168

PCT Pub. Date: May 28, 2009

(65) Prior Publication Data

US 2010/0307384 A1 Dec. 9, 2010

(51) Int. Cl.

| | |
|---|---|
| ***B65D 30/16*** | (2006.01) |
| ***B65D 33/10*** | (2006.01) |
| ***B65D 33/16*** | (2006.01) |
| ***B65D 33/00*** | (2006.01) |
| ***B65D 33/04*** | (2006.01) |

(52) U.S. Cl.
USPC ..... 383/104; 383/9; 383/67; 383/211; 383/106

(58) Field of Classification Search
USPC ..... 383/67, 104, 9, 210, 211, 106, 10, 383/93, 98, 99, 907, 35, 36, 95
See application file for complete search history.

(56) References Cited

U.S. PATENT DOCUMENTS

| | | | | |
|---|---|---|---|---|
| 2,355,313 | A * | 8/1944 | Lurie | 222/528 |
| 3,567,108 | A * | 3/1971 | Corridon | 229/117.23 |
| 3,738,566 | A * | 6/1973 | Foster | 383/37 |
| 4,576,316 | A * | 3/1986 | Foster | 222/541.6 |
| 4,789,067 | A * | 12/1988 | Silano | 229/249 |
| 5,134,875 | A * | 8/1992 | Jensen et al. | 73/1.03 |
| 6,254,273 | B1 * | 7/2001 | Galomb et al. | 383/63 |
| 6,273,610 | B1 * | 8/2001 | Koyama et al. | 383/207 |
| 6,296,388 | B1 * | 10/2001 | Galomb et al. | 383/63 |
| 2009/0022433 | A1 * | 1/2009 | Goglio et al. | 383/104 |
| 2009/0097786 | A1 * | 4/2009 | Goglio et al. | 383/211 |

FOREIGN PATENT DOCUMENTS

| | | | |
|---|---|---|---|
| DE | 3941300 | A1 * | 6/1991 |
| DE | 4133959 | A1 * | 4/1993 |
| JP | 07264963 | A * | 10/1995 |
| JP | 2005008220 | A * | 1/2005 |
| JP | 2008007174 | A * | 1/2008 |

* cited by examiner

*Primary Examiner* — Jes F Pascua
(74) *Attorney, Agent, or Firm* — Julie M. Lappin; Robert M. Barrett

(57) ABSTRACT

A pouch comprising a first panel comprising a first flap having an interior and a second panel comprising a second flap having an interior. The second panel is attached to the first panel and portions of the first panel and the second panel define a chamber and an outlet. The pouch further comprises a strip removably attached to a portion of the interior of the first flap and a portion of the interior of the second flap and covering the outlet formed by the first panel and the second panel.

15 Claims, 4 Drawing Sheets

BOTTOM OPENING POUCHES AND CONSUMER PRODUCTS MADE USING SUCH POUCHES

CROSS REFERENCE TO RELATED APPLICATIONS

This application is a national stage application under 35 U.S.C. §371 of PCT/US2008/012779 filed Nov. 13, 2008, which claims priority to U.S. Provisional Application Ser. No. 61/003,638 filed Nov. 19, 2007, the disclosures of which are incorporated herein by this reference.

BACKGROUND OF THE INVENTION

1. Field of the Invention

The invention relates generally to product containers and particularly to bottom opening pouches useful for containing compositions and materials and consumer products made using such pouches.

2. Description of Related Art

Containers or packaging for products are designed in different sizes and shapes and for different uses. Packages that are easy to open and give a consumer easy access to a product contained in the package are particularly popular. In marketing a product, containers that can be readily displayed are desirable. Similarly, packages that maximize the space of a display and increase the desirable appearance of the display can lead to greater consumer appeal. This can lead to greater sales of the consumer product. Further, many packaged products are harmful if touched or are undesirable to touch. There is, therefore, a need for new containers such as pouches that meet consumer needs, particularly pouches that are easy to open and handle and/or that can dispense its contents without consumer contact with the contents.

U.S. Pat. No. 6,270,821 discloses a multipurpose marketing pouch useful for meat products such as poultry products. US20050276885 discloses a self-venting microwaveable pouch for use in heating a food item in a microwave oven. The Pouch includes a rupturable seal having a portion that breaks to release steam generated by a heated food item within the pouch when the food item is sufficiently heated in a microwave oven. US20070148295 discloses a method for manufacturing a food article for immediate consumption that is packed in a flexible plastic pouch-type package kept stable at room temperature. The method involves removing oxygen from the pouch and sealing the pouch after the right amount of meat and sauce are placed in the pouch, sterilizing the pouch, cooling the pouch, and incubating the pouch. US20070184154 discloses a pouch useful for cooking food items, comprising a cover comprising a score layer with a weak portion that ruptures and vents the pouch at a predictable location when pressure within the pouch exceeds predetermined pressure due to hot gases.

SUMMARY OF THE INVENTION

The present invention provides new packaging and methods of making and using the packaging. In a general embodiment, the present invention provides a pouch comprising a first panel comprising a first flap having a first side and a second side, and a second panel comprising a second flap having a first side and a second side. The second panel is attached to the first panel, and portions of the first panel and the second panel define a chamber and an outlet. The pouch further comprises a strip removably attached to a portion of the first side of the first flap and a portion of the first side of the second flap, and covering the outlet formed by the first panel and the second panel.

In one embodiment, the first panel and the second panel are attached along edges of the first and second panel and define a chamber. In another embodiment, the pouch comprises a product positioned within the first panel and the second panel. In a further embodiment, the first panel and the second panel define an aperture.

In another embodiment, at least one of the first panel and the second panel comprise a transparent portion and an opaque portion. In a further embodiment, the removable strip comprises a pull-tab. In another embodiment, the removable strip comprises a ring.

In an embodiment, the first panel and/or the second panel comprise a metal foil, a high barrier retortable film, a polymeric material, or combination thereof.

In an embodiment, the removable strip comprises an adhesive layer attached to a thermoplastic material.

In an embodiment, the pouch is constructed and arranged to stand vertically on a surface formed by the first flap and the second flap.

In an embodiment, the first panel and/or the second panel comprises a ring.

In another embodiment, the present invention provides a pouch comprising a first panel comprising a first flap and a second panel comprising a second flap which is attached to the first panel. The first flap is wider than the first panel, and the second flap is wider than the second panel. Portions of the first panel and the second panel define a chamber and an outlet. The first panel and the second panel define an aperture. The pouch further comprises a strip removably attached to a portion of the first flap and the second flap, and covering the outlet formed by the first panel and the second panel.

In a further embodiment, the first panel and the second panel are attached along edges of the first and second panel.

The present invention has several advantages, e.g., it provides an improved package, an improved pouch and method of using a pouch, an improved method of making a pouch, and an improved method of marketing a product.

Other and further objects, features, and advantages of the present invention will be readily apparent to those skilled in the art.

DETAILED DESCRIPTION OF THE INVENTION

In one aspect, the present invention provides packages and methods of making and using packages, specifically packages that comprise pouches. For example, the pouch can be easy to open and, once opened, provide an opening that makes it easy to remove the product from the pouch. The pouch can be suitable for containing any type of product such as human and pet foods. The pouch can be opened at the bottom by removing, for example, a sealed pull tab. The open pouch can have a wide opening that facilitates product removal without the consumer having to touch the product. The opening portion of the pouch can also be configured to allow the pouch to stand up on the shelf or display.

Figure 1:
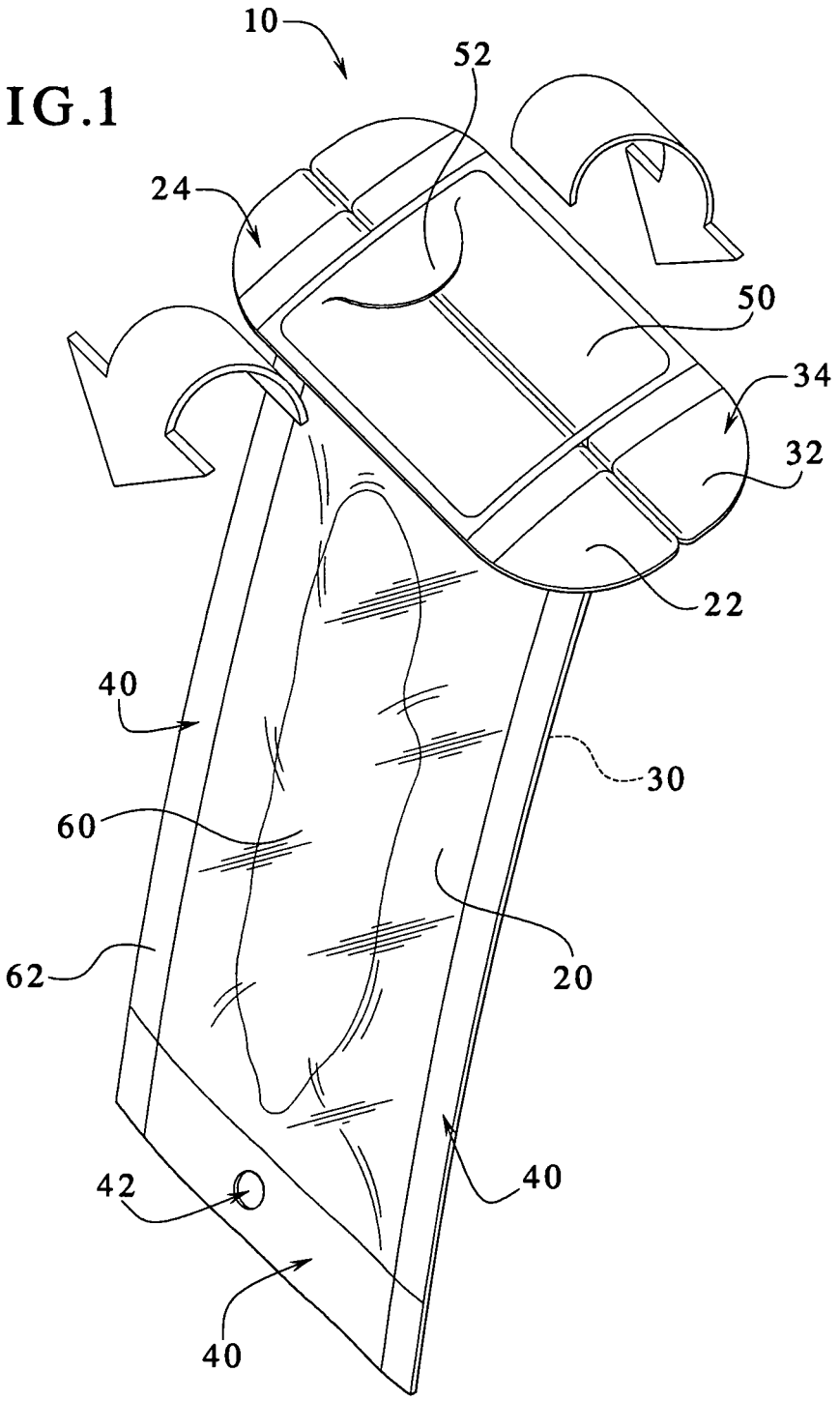
FIG. 1 illustrates a bottom perspective view of the pouch in an embodiment of the present invention.
Figure 2:
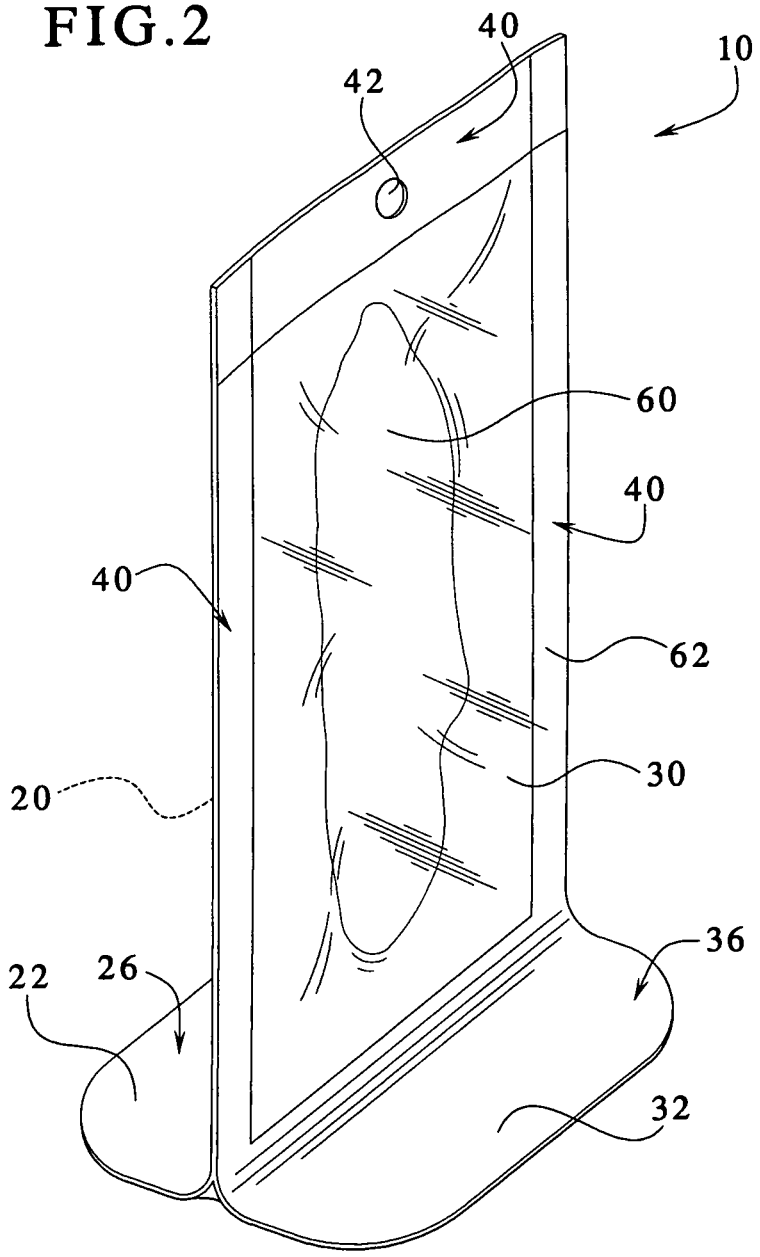
FIG. 2 illustrates a perspective view of the pouch in a standing position in an embodiment of the present invention.

In a general embodiment illustrated in FIGS. 1 and 2, the present invention provides a pouch 10 comprising a first panel 20 comprising a first flap 22 having a first side 24 (e.g., interior side) and a second side 26 and a second panel 30 comprising a second flap 32 having a first side 34 (e.g., interior side) and a second side 36. For example, the first side 24 or interior of the first flap 30 and the second side 34 or interior of the second flap 32, correspond to the same inner surface or sides of the first panel 20 and the second panel 30. The second panel 30 is attached to the first panel 20. For example, the first panel 20 and the second panel 30 can be attached along edges 40 of the first and second panel 20 and 30 using any suitable fastening means, e.g., heat sealing, adhesives, ultrasonic sealing, and mechanical fasteners.

The first panel 20 and the first flap 22 can comprise a unitary piece made from the same or different materials. Similarly, the second panel 30 and the second flap 32 can also comprise a unitary piece made from the same or different materials. In another embodiment, the flaps can also be wider (e.g., from side to side) than their corresponding panels. This can provide the pouch with a more stable base or foundation when the pouch is in a standing position during display.

The pouch 10 further can comprise a strip 50 removably attached to a portion of the first side 24 of the first flap 22 and a portion of the first side 34 of the second flap 32. For example, the first flap 22 and the second flap 32 are folded outwardly so that the strip 50 can be attached to portions of the first sides 24 and 34 of the first and second flaps 22 and 32, respectively. In this embodiment, the removable strip 50 comprises a pull-tab 52, for example, to enable a user to easily remove the strip 50 from the pouch 10.

The first panel 20 and the second panel 30 that are attached along edges 40 define a chamber for storing a product such as a human or pet food. Alternatively, any other suitable non-consumable products can also be stored in the pouch.

Figure 3:
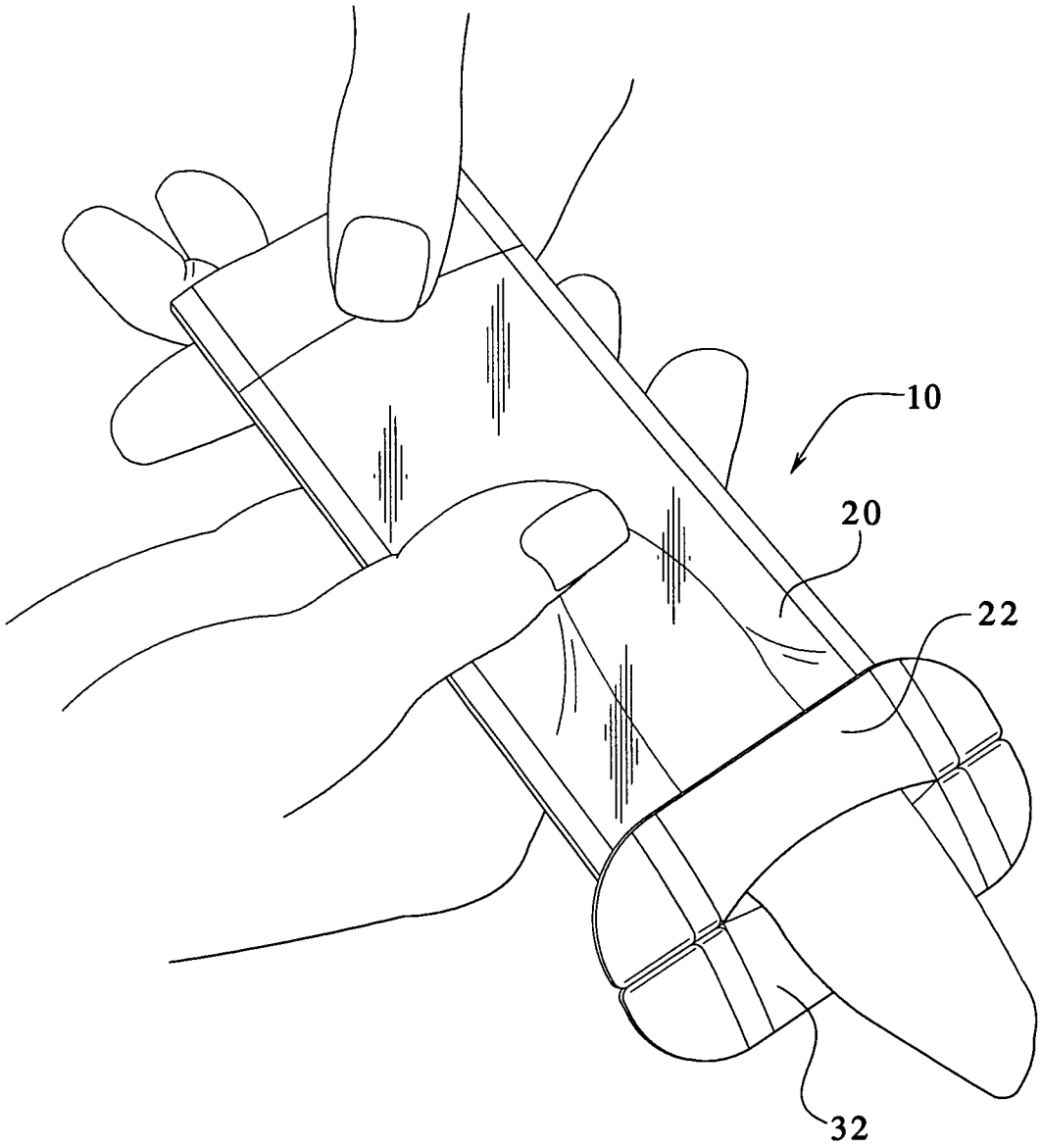
FIG. 3 illustrates a perspective view of the pouch in use in an embodiment of the present invention.

The first panel 20 and the second panel 30 that are attached along edges 40 also define an outlet or opening near the first flap 22 and the second flap 32, so that the product can be removed from the pouch 10, for example, by squeezing the pouch 10 after the strip 50 has been removed, as illustrated in FIG. 3. It should be appreciated that portions of the first panel 20 and the second panel 30 forming the outlet can be removably sealed at the outlet portion of the package. As a result, after removing the strip 50, the user or consumer may have to pull the first flap 30 and the second flap 32 away from each other as illustrated in FIG. 1, to break the seal between the first panel 20 and the second panel 30 and expose the outlet.

The outlet of the pouch 10 can be any suitable size. For example, in alternative embodiments, the pouch can have wider opening areas to have better product release from the pouch, or smaller openings for a more controlled product release.

As illustrated in FIGS. 1 and 2, the first panel 20 and the second panel 30 can define an aperture 42 or other suitable hole. The aperture 42 can be used to hang the pouch 10 during display, for example, using a peg board on a store shelf.

One or more portions of the first panel 20 and/or the second panel 30 can comprise a transparent portion 60 and an opaque portion 62. This allows the consumer to view the product inside of the pouch 10. It should be appreciated that the first and second panels 20 and 30 can be partially or entirely transparent, semitransparent or opaque. This provides additional marketing opportunities for the product in the pouch. The transparent portion 60 and the opaque portion 62 can be any suitable shape and configuration to allow the consumer to see as little or as much of the product within the pouch as desired.

The first panel 20 and the second panel 30 can be made from any suitable materials such as, for example, a high barrier retortable film such as aluminum oxide coated, or silicon oxide coated, film. The first flap 22 and the second flap 32 can also be made from any suitable materials such as, for example, a high barrier retortable film. The films can be single-layer films or multilayer films. The first panel 20 and/or the second panel 30 can also be a polymeric material, or a metal foil such as an aluminum foil material.

The removable strip 50 can be made from any suitable material and can be attached to portions of the first flap 22 and the second flap 32 using any suitable attachment mechanism such as, for example, an adhesive layer attached to the first flap 22 and the second flap 32. The strip 50 can be made from a single-layer film or multilayer film. The strip 50 can also be any retortable material having an easy peeling feature on the sealant layer, which can comprise a suitable polymer such as polypropylene.

In an embodiment, the pouch 10 is constructed and arranged to stand vertically on a surface formed by the first flap 22 and the second flap 32 as illustrated in FIG. 2. For example, this allows the pouch to be stood up and displayed on a store shelf or table.

In another embodiment, the first panel and/or the second panel comprise a ring. For example, the ring can be attached to an edge of the first and/or second panel, defining a hole for the user to grasp and pull the first and second panels from each other to expose the product in the pouch. The removable strip can partially or entirely cover the outer surfaces of the first and/or second panels, including the surface area of the ring.

Figure 4:
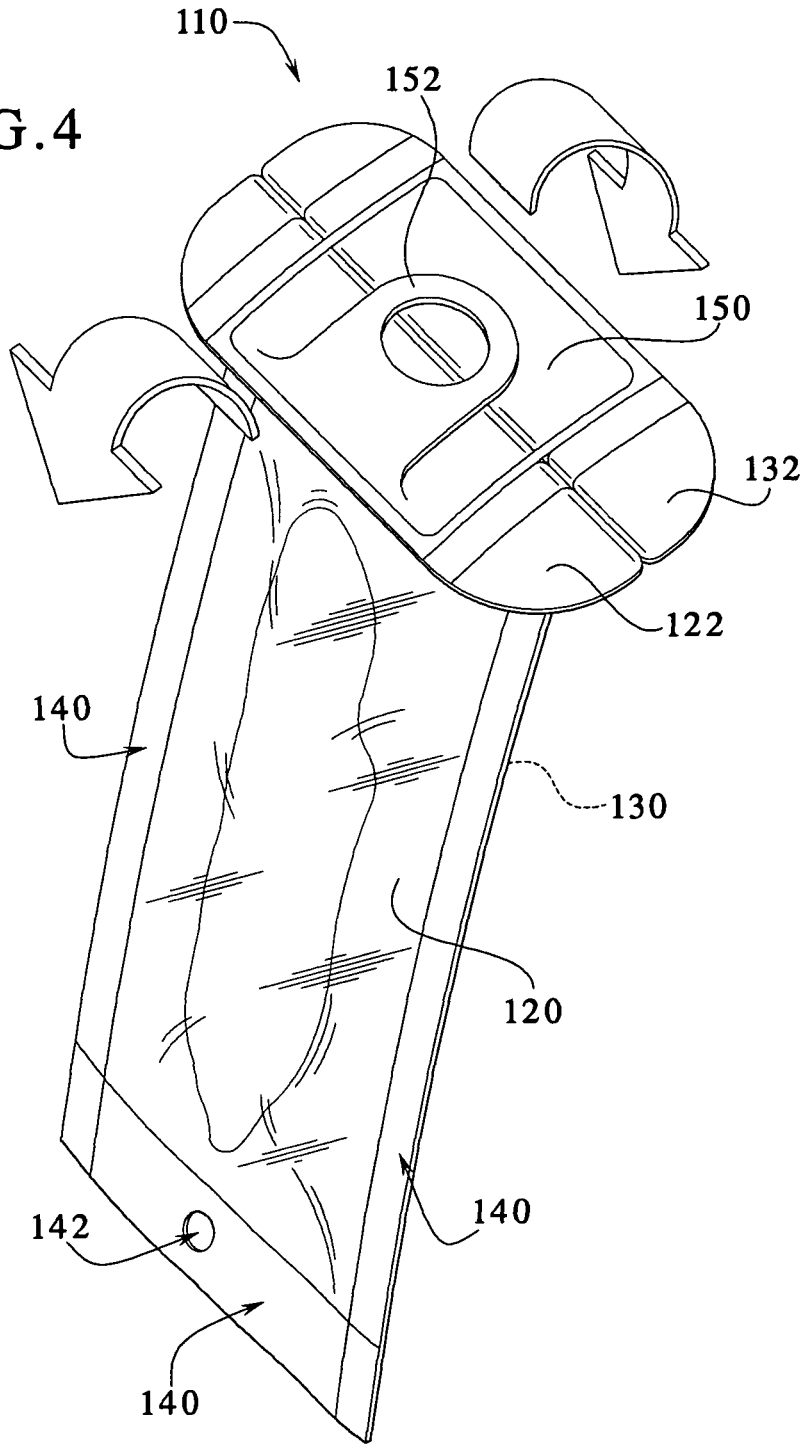
FIG. 4 illustrates a bottom perspective view of the pouch in another embodiment of the present invention.

In an alternative embodiment illustrated in FIG. 4, the present invention provides a pouch 110 comprising a first panel 120 comprising a first flap 122 and a second panel 130 comprising a second flap 132. The second panel 130 is attached to the first panel 120, for example, along edges 140 of the first and second panels 120 and 130. Portions of the first panel 120 and the second panel 130 define a chamber for storing a product and an outlet for releasing the product. The pouch 110 further comprises a strip 150 removably attached to a portion of the first flap 122 and the second flap 132, and covering the outlet formed by the first panel 120 and the second panel 130. In this embodiment, the removable strip 150 comprises a ring 152.

It should be appreciated that the first panel 120 and the first flap 122 can comprise a unitary piece made from the same or different materials. Similarly, the second panel 130 and the second flap 132 can also comprise a unitary piece made from the same or different materials. In an embodiment, one or more portions of the first panel and/or the second panel can comprise a transparent portion and an opaque portion.

Portions of the first panel 120 and the second panel 130 forming the outlet can be removably sealed at the outlet portion of the package. As a result, after removing the strip 150, the user or consumer may have to pull the first flap 130 and the second flap 132 away from each other to break the seal between the first panel 120 and the second panel 130 and expose the outlet as illustrated in FIG. 4.

In another aspect as illustrated in FIG. 3, the present invention provides a method for using a pouch. This method comprises providing a pouch comprising a first panel comprising a first flap, and a second panel comprising a second flap and attached to the first panel so that portions of the first panel and the second panel define a chamber comprising a product and a releasably sealed outlet.

A strip is removably attached to a portion of the first flap and the second flap and covers the releasably sealed outlet formed by the first panel and the second panel. The strip is removed from the first flap and the second flap and the pouch is squeezed along a portion of the first panel and the second panel to remove the product from the pouch through the releasably sealed outlet. If necessary the user or consumer can pull the first flap and the second flap to expose the outlet and/or the product in the container. The product can be an edible product such as, for example, retortable, real meat treats.

In another aspect, the present invention provides a method of making a pouch. This method comprises providing a first panel comprising a first flap and sealing a second panel comprising a second flap to the first panel along the edges of the first and second panels to define a chamber so that portions of the first panel and the second panel define an outlet, preferably a releasably sealed outlet. The sealing can be done using any suitable mechanism, such as, for example, heat sealing the edges together, applying an adhesive between the edges, or using mechanical fasteners on the edges. The sealing of the first panel and the second panel at the outlet location can be done using sealer that allows a consumer to pull the panels away from each other to expose the outlet and/or the product in the chamber. The method further comprises attaching a removal strip to a portion of the first flap and the second flap and covering the releasably sealed outlet formed by the first panel and the second panel.

In an embodiment, the method comprises providing a product in the chamber of the pouch before attaching the removable strip. For example, the product can be introduced into a preformed pouch from either end of the pouch. It should be appreciated that making the pouch can utilize existing retort pouch filling and sealing machinery for production. After the pouch is filled, the end where the pouch was filled can be sealed together, e.g., using heat sealing, adhesive, ultrasonic sealing, and the like.

The method further comprises attaching a removal strip to interior portions of the first flap and the second flap and covering the outlet formed by the first panel and the second panel.

In an embodiment, the method comprises providing a product in the chamber of the pouch before attaching the removable strip.

In another aspect, the present invention provides a method of packaging a product. The method comprises providing a pouch comprising a first panel comprising a first flap, and a second panel comprising a second flap and attached to the first panel so that portions of the first panel and the second panel define a chamber comprising the product and an outlet. A strip is removably attached to an interior portion of the first flap and the second flap, covering the outlet formed by the first panel and the second panel. The strip is removed from the first flap and the second flap, and the pouch is squeezed along a portion of the first panel and the second panel to remove the product from the pouch through the outlet.

In an embodiment, the product comprises an edible product.

In another aspect, the present invention provides a method of marketing a product. The method comprises providing a pouch comprising a first panel comprising a first flap, and a second panel comprising a second flap and attached to the first panel. Portions of the first panel and the second panel define a chamber containing the product and an outlet. A strip is removably attached to interior portions of the first flap and the second flap, covering the outlet formed by the first panel and the second panel. The pouch is then displayed in any suitable manner.

In an embodiment, the pouch is displayed by standing the pouch on a base provided by the removable strip attached to portions of the first flap and the second flap.

In an embodiment, the first panel and the second panel define an aperture and the pouch is displayed by hanging the pouch on a peg.

In another aspect, the present invention provides a consumer product. The product comprises a material or composition inside a pouch. The pouch comprises a first panel comprising a first flap having a first side and a second side; a second panel comprising a second flap having a first side and a second side, the second panel attached to the first panel, portions of the first panel and the second panel defining a chamber and an outlet; and a strip removably attached to a portion of the first side of the first flap, and a portion of the first side of the second flap and removably covering the outlet formed by the first panel and the second panel. The composition can be any composition compatible with the pouch. In one embodiment, the composition is an edible composition. The edible composition can be fruits, vegetables, nuts, raw foods, processed foods, meats, and the like, preferably a meat. The meat can be a processed meat or a whole meat. In a preferred embodiment, the meat is a strip of real chicken. In another embodiment, the composition is an extruded food composition, preferably a pet food composition. In a most preferred embodiment, the product is a piece of raw or cooked meat useful as a pet food, snack, or treat, preferably a strip of chicken useful as a pet treat.

The composition or material can be a non-edible composition or material such as a detergent, a plastic spoon and fork, a caustic bleach, a sauce, a paint, and the like. The pouches are particularly useful for containing compositions and materials that the consumer wants to avoid contact with, for aesthetic or physical reasons, e.g., it is unpleasant to touch the composition or material, touching the composition or material could harm the consumer, or touching the composition or material would contaminate the composition or material.

In another aspect, the present invention provides a product display. The display comprises a device suitable for containing and showing a pouch or consumer product as described herein. The display can be any device compatible with the pouch or consumer product, but is preferably a freestanding, table top, or wall-mounted case. The pouch comprises a first panel comprising a first flap having a first side and a second side; a second panel comprising a second flap having a first side and a second side, the second panel attached to the first panel, portions of the first panel and the second panel defining a chamber and an outlet; and a strip removably attached to a portion of the first side of the first flap, and a portion of the first side of the second flap and removably covering the outlet formed by the first panel and the second panel. The display is useful for marketing the pouch or consumer product by drawing the consumer's attention to the product.

Unless defined otherwise, all technical and scientific terms and any acronyms used herein have the same meanings as commonly understood by one of ordinary skill in the art in the field of the invention. Although any compositions, methods, articles of manufacture, or other means or materials similar or equivalent to those described herein can be used in the practice of the present invention, the preferred compositions, methods, articles of manufacture, or other means or materials are described herein.

In the specification, there have been disclosed typical preferred embodiments of the invention and, although specific terms are employed, they are used in a generic and descriptive sense only and not for purposes of limitation, the scope of the invention being set forth in the claims. Obviously many modifications and variations of the invention are possible in light of the above teachings. It is therefore to be understood that within the scope of the appended claims the invention may be practiced otherwise than as specifically described.

What is claimed is:

1. A pouch comprising:

a first panel comprising a first flap having a first side and a second side;

a second panel comprising a second flap having a first side and a second side, the second panel attached to the first panel by edges of the second panel that are positioned on and affixed to edges of the first panel, portions of the first panel and the second panel defining a chamber and an outlet; and a strip removably attached to a portion of the first side of the first flap and a portion of the first side of the second flap and removably covering the outlet formed by the first panel and the second panel, the pouch constructed and arranged to stand vertically on a substantially flat surface formed by the strip, the first flap and the second flap; the entirety of the strip is substantially coplanar with at least one of the first flap or the second flap; and the first flap and the second flap extend outward from the outlet.

2. The pouch of claim 1 wherein the first flap and the second flap form the bottom of the pouch, and the edges of the first panel and the second panel that are opposite to the first flap and the second flap form the top of the pouch opposite to the bottom.

3. The pouch of claim 1 comprising a product positioned within the first panel and the second panel.

4. The pouch of claim 1 wherein the first panel and the second panel define an aperture on an opposite end of the pouch relative to the outlet.

5. The pouch of claim 1 wherein at least one of the first panel and the second panel comprises a transparent portion and an opaque portion.

6. The pouch of claim 1 wherein the removable strip comprises a pull-tab.

7. The pouch of claim 1 wherein the removable strip comprises a ring.

8. The pouch of claim 1 wherein at least one of the first panel and the second panel comprises a material selected from the group consisting of a metal foil, a high barrier retortable film, a polymeric material, and combinations thereof.

9. The pouch of claim 1 wherein the removable strip comprises an adhesive layer attached to a thermoplastic material.

10. A pouch comprising:

a first panel comprising a first flap, the first flap being wider than the first panel;

a second panel comprising a second flap and attached to the first panel by edges of the second panel that are positioned on and affixed to edges of the first panel, the second flap being wider than the second panel, portions of the first panel and the second panel defining a chamber and an outlet, the first panel and the second panel defining an aperture; and a strip removably attached to interior portions of the first flap and the second flap and covering the outlet formed by the first panel and the second panel.

11. The pouch of claim 10 wherein the pouch is constructed and arranged to stand vertically on a substantially flat surface formed by the strip, the first flap and the second flap.

12. The pouch of claim 10 wherein at least one of the first panel and the second panel comprises a transparent portion and an opaque portion.

13. The pouch of claim 10 wherein at least one of the first panel and the second panel comprises a material selected from the group consisting of a metal foil, a high barrier retortable film, a polymeric material, and combinations thereof.

14. The pouch of claim 10 wherein the removable strip comprises an adhesive layer attached to a thermoplastic material.

15. The pouch of claim 10 comprising a product positioned within the first panel and the second panel.

* * * * *